US009890507B2

(12) United States Patent
Park et al.

(10) Patent No.: US 9,890,507 B2
(45) Date of Patent: Feb. 13, 2018

(54) GUARD CABLE FOR ROAD

(71) Applicants: KUMDONG STEEL CONSTRUCTION CO., LTD, Gyeongsangnam-do (KR); Joong Suk Park, Busan (KR); Mi Rye Seo, Busan (KR)

(72) Inventors: Joong Suk Park, Busan (KR); Mi Rye Seo, Busan (KR)

(73) Assignee: KUMDONG STEEL CONSTRUCTION CO., LTD, Gyeongsangnam-do (KR)

( * ) Notice: Subject to any disclaimer, the term of this patent is extended or adjusted under 35 U.S.C. 154(b) by 541 days.

(21) Appl. No.: 14/361,487

(22) PCT Filed: Nov. 29, 2012

(86) PCT No.: PCT/KR2012/010261
§ 371 (c)(1),
(2) Date: May 29, 2014

(87) PCT Pub. No.: WO2013/081402
PCT Pub. Date: Jun. 6, 2013

(65) Prior Publication Data

US 2014/0332740 A1 Nov. 13, 2014

(30) Foreign Application Priority Data

Nov. 30, 2011 (KR) ..... 10-2011-0126744

(51) Int. Cl.
*E01F 15/06* (2006.01)
*E01F 15/14* (2006.01)

(52) U.S. Cl.
CPC ..... *E01F 15/06* (2013.01); *E01F 15/145* (2013.01)

(58) Field of Classification Search
CPC ..... E01F 15/00; E01F 15/06; E01F 15/145; E01F 15/146; E04H 17/02; E04H 17/04; E04H 17/06; E04H 17/10; E04H 17/12
(Continued)

(56) References Cited

U.S. PATENT DOCUMENTS 1,883,879 A * 10/1932 Cole ..... E01F 15/06 248/66
2,288,845 A * 7/1942 Schilling ..... E01F 15/06 248/66

(Continued)

FOREIGN PATENT DOCUMENTS

KR 20-0234914 * 10/2001 ..... E01F 7/04
KR 20-0287791 * 9/2002 ..... E01F 7/00

(Continued)

OTHER PUBLICATIONS

Translation of KR 20-0234914. The fixing part of intersection of the wire rope for the falling rock blocking net. Na, Jae-Sul. Oct. 8, 2001.*

(Continued)

*Primary Examiner* — Josh Skroupa
(74) *Attorney, Agent, or Firm* — AKC Patents, LLC

(57) ABSTRACT

A guard cable for a road, includes a plurality of wire ropes extending in a horizontal direction with respect to a plurality of supports provided on the side of the road at intervals. The wire ropes are shifted to a predetermined width from the supports to the roadway by a wire rope protrusion installation unit. The plurality of wire ropes provided between the supports are maintained at constant intervals by an interval maintenance plate.

7 Claims, 9 Drawing Sheets

(58) Field of Classification Search
USPC ..... 256/1, 13.1, 40–44, 48, 49, 52, 54, 55
See application file for complete search history.

(56) References Cited

U.S. PATENT DOCUMENTS 4,709,887 A * 12/1987 Bongiovanni ..... F16L 3/2235
248/66
8,266,803 B2 * 9/2012 Neusch ..... E01F 15/06
256/13.1

FOREIGN PATENT DOCUMENTS

KR 10-2009-0113997 * 11/2009 ..... E01F 7/04
KR 10-1049437 * 7/2011 ..... E01F 15/00

OTHER PUBLICATIONS

Translation of KR 20-0287791. The fence for the prevention for falling stone iin which the buffer is equipped. Son, Jeng-Ik. Sep. 9, 2002.*
Translation of KR 10-2009-0113997. Prevention fence for falling stone with wire guardrail. Park, et al. Apr. 29, 2008.*
Translation of KR 10-1049437. The stable structure for the road in which it is installed to pull. Park, et al. Jul. 15, 2011.*

* cited by examiner

GUARD CABLE FOR ROAD

CROSS-REFERENCE TO RELATED APPLICATIONS

This application is a National phase of PCT patent Application No. PCT/KR2012/010261 having International filing date of Nov. 29, 2012 which claims the benefit of priority of Korean Patent Application No. 10-2011-0126744 filed on Nov. 30, 2011. The contents of the above applications are all incorporated by reference as if fully set forth herein in their entirety.

TECHNICAL FIELD

The present invention relates to a guard cable for a road, and more particularly, to a guard cable for a road in which wire ropes of several lines installed in a horizontal direction at a plurality of supports installed at a gap at the roadside are inwardly installed by a predetermined width from a support to the roadside by a wire rope protrusion installation means and that can minimize a load to concentrate only to one or two wire ropes of wire ropes of several lines, when a vehicle collides with a guard cable by enabling wire ropes of several lines installed between supports to maintain a constant gap by a gap holder and that can minimize that the vehicle colliding with the guard cable falls to the outside of the road in which the guard cable is installed.

BACKGROUND ART

A conventional general guard cable for a road prevents a vehicle travelling the road from falling to the outside of the road by installing a plurality of supports at a gap of about 5 meters at the roadside and by horizontally installing wire ropes of several lines (3-5 lines) at a gap at the supports.

In this way, in a state in which the guard cable for a road is installed at the roadside, when a vehicle travelling the road collides with the guard cable while deviating from a lane, wire ropes of several lines do not distribute an impact load when the vehicle collides and thus a phenomenon occurs that the impact load is concentrated to only one or two wire ropes in which the vehicle collides.

When a vehicle collides, as an impact load is concentrated to only a wire rope of one or two lines, a problem occurs that only a corresponding wire rope does not endure an impact load when the vehicle collides and that the vehicle falls to the outside of the road while the wire rope is instantaneously loosely untied or that the vehicle is caught between loosely untying wire ropes.

DETAILED DESCRIPTION OF INVENTION

Technical Problem

The present invention has been made in view of the above problems, and provides a guard cable for a road in which a wire rope installed at a support is inwardly installed by a predetermined width from a support to the roadside by a wire rope protrusion installation means and in which a vehicle first collides with a wire rope of a position protruded to the roadside when a vehicle collides with a guard cable by connecting wire ropes of several lines installed between supports to maintain a constant gap by a gap holder and in which the entire of several wire ropes connected by the gap holder including a wire rope in which the vehicle together collides supports an impact load operating when the vehicle collides, as wire ropes of several lines are connected to maintain a constant gap by a gap holder and that can thus prevent that the vehicle colliding with the guard cable falls to the outside of the road in which the guard cable is installed or that the vehicle is caught between wire ropes.

The present invention further provides a guard cable for a road in which uneven portions that hold and fix to prevent a wire rope from sliding are each formed in a wire rope holder and a wire rope support that fix and hold a wire rope and in which several wire ropes are tightly installed while preventing several wire ropes installed between supports from drooping in normal times by installing a fixing screw in the wire rope holder and in which several wire ropes can distribute and support a load operating when the vehicle collides while maintaining a tight state between adjacent supports even when the vehicle collides.

Technical Solution

In accordance with an aspect of the present invention, a guard cable for a road in which a plurality of supports are installed at a gap at the roadside and in which wire ropes of several lines are parallelly extended in a lengthwise direction between each of the supports, wherein a receiving groove in which the wire rope is received at a front surface is located so that a wire rope support formed in a lengthwise direction of the wire rope protrudes from the support to the roadside and thus the each wire rope is protruded from the support to the roadside, and in a state in which the wire rope is received at the receiving groove, a wire rope holder is installed in the support in a state that encloses the wire support including the wire rope.

Preferably, in the support, an inward groove is formed in a vertical lengthwise direction, and in an inlet of the inward groove, a clamp that fastens the wire rope holder is installed, and at both ends of the clamp, an opening groove that receives a fastening device for fastening to the wire rope holder is formed.

Preferably, a groove is formed in the clamp, and in the groove, a rear protrusion formed in the wire rope support is received.

Preferably, at the inside of the wire rope holder and the receiving groove, uneven portions that prevent the wire rope from sliding are each formed.

Preferably, the guard cable further includes a fixing screw having the front end that close contacts with a wire rope received at the receiving groove by penetrating the wire rope holder.

Preferably, the guard cable further includes a gap holder that holds the parallelly extended wire ropes at a constant gap, wherein the gap holder couples a clamp formed to enclose each of wire ropes with the wire ropes interposed therebetween to a support with a fixing member in a state in which the support simultaneously supports the wire ropes.

Preferably, the guard cable further includes an auxiliary support installed at a predetermined gap from the support installed at both side end portions or one side end portion of the supports, wherein a pulling device of a turnbuckle form is connected between the support of the end portion side and the auxiliary support, and a connector is installed by a fixing member between both end portions of the pulling device and the support and the auxiliary support corresponding to the both end portions.

Preferably, both end portions of the each wire rope are coupled to an end portion of a splicer that penetrates the support of the end portion side of both sides.

Advantageous Effects

As described above, according to a guard cable for a road of the present invention, as a wire rope is installed to protrude to the roadside in a support, when a vehicle collides with a guard cable, a probability in which a vehicle colliding with the guard cable for a road falls to the outside of the road by a distance (width) in which the wire rope is installed to protrude to the roadside can be reduced.

Further, as wire ropes of several lines are connected to maintain a constant gap by a gap holder, the entire of several wire ropes connected by a gap holder including a wire rope in which a vehicle collides together supports an impact load operating when the vehicle collides and thus it can be prevented that the vehicle colliding with the guard cable from falling to the outside of the road in which the guard cable is installed or from being caught between wire ropes.

In a wire rope holder and a wire rope support that fix and hold a wire rope, uneven portions that hold and fix to prevent the wire rope from sliding are each formed, and in the wire rope holder, as a fixing screw is installed, in normal times, several wire ropes are tightly installed while preventing several wire ropes installed between supports from drooping, and even when a vehicle collides, several wire ropes can distribute and support a load operating when the vehicle collides while maintaining a tight state between adjacent supports.

BEST MODES FOR CARRYING OUT THE INVENTION

Hereinafter, a guard cable for a road according to an exemplary embodiment of the present invention will be described with reference to FIGS. 1 to 9.

Figure 1:
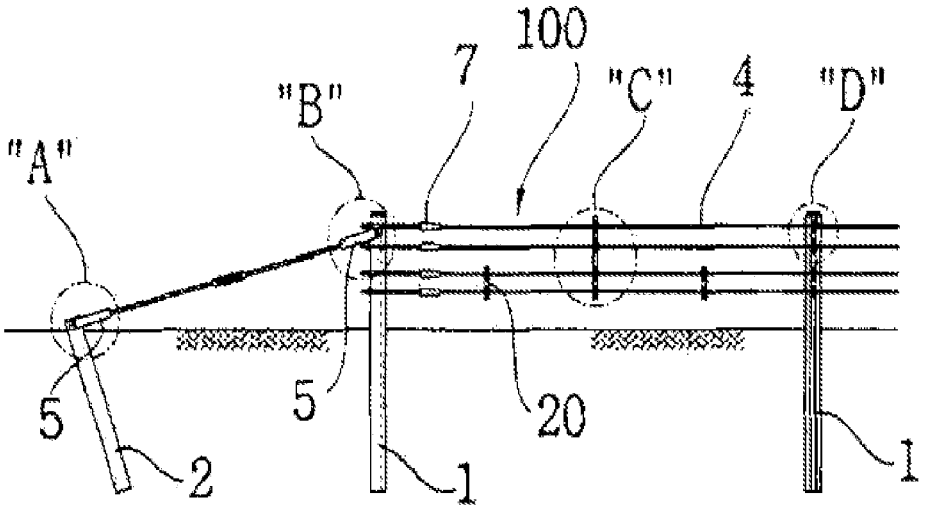
FIG. 1 is a diagram illustrating a state in which a guard cable for a road is installed according to an exemplary embodiment of the present invention.
Figure 2:
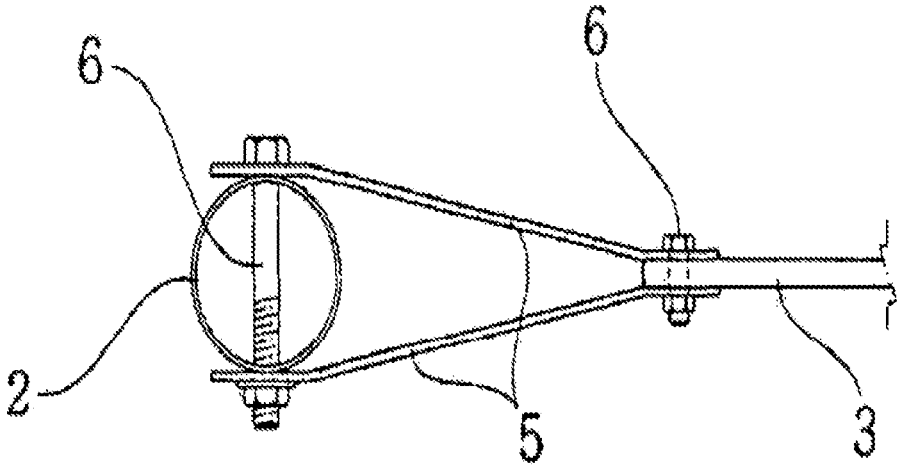
FIG. 2 is an enlarged top plan view of a portion "A" of FIG. 1.
Figure 3:
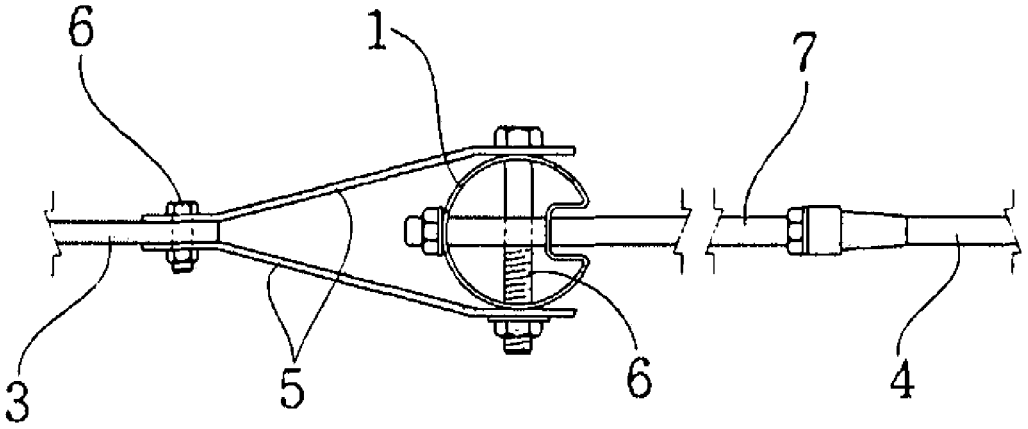
FIG. 3 is an enlarged top plan view of a portion "B" of FIG. 1.

As shown in FIG. 1, the present invention relates to a guard cable for a road in which a plurality of supports 1 are vertically installed at a gap at the roadside and in which wire ropes 4 of several lines are parallelly installed at a gap in a lengthwise direction between each of the supports 1.

Figure 6:
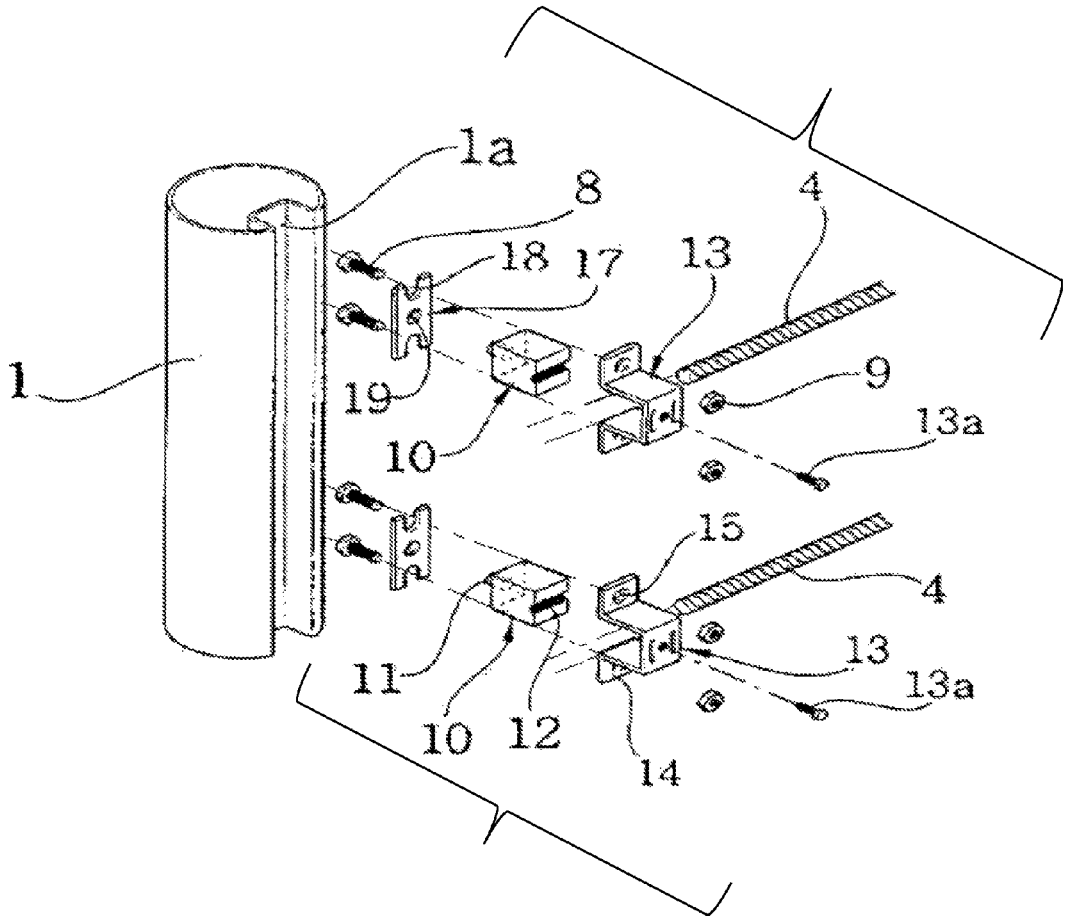
FIG. 6 is an enlarged exploded perspective view of a portion "D" of FIG. 1.
Figure 7:
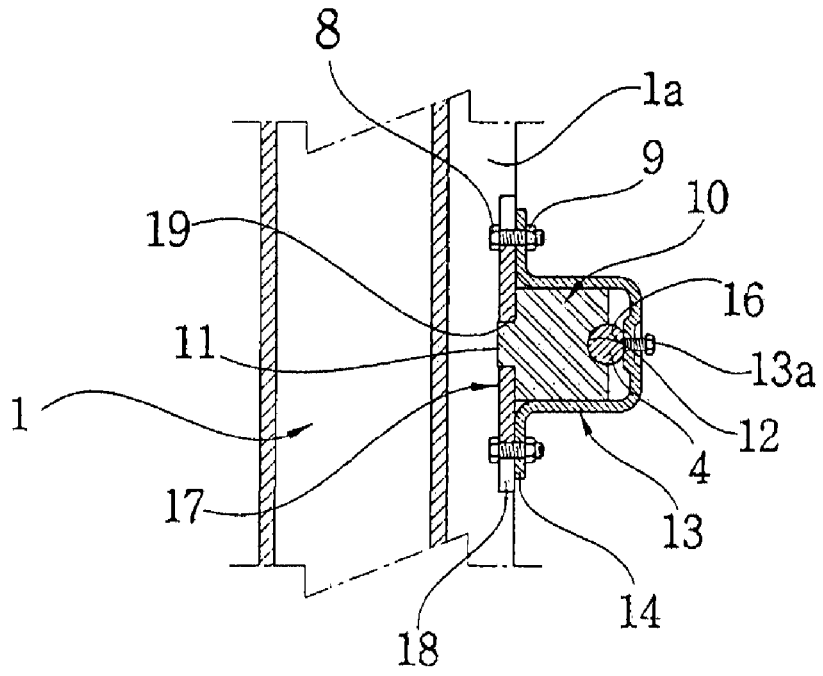
FIG. 7 is a side cross-sectional view illustrating an example of an installation state of a wire rope, which is a main element of the present invention.

As shown in FIGS. 1, 6, and 7 illustrating a main portion according to an exemplary embodiment of the present invention, at the front side of the support 1, an inward groove 1*a* is formed in a vertical lengthwise direction, and at an inlet of the inward groove 1*a* of the side through which each wire rope 4 passes, opening grooves 18 are formed in an upper portion and a lower portion, and in an intermediate portion thereof, a clamp 17 having a groove 19 is fixed and coupled.

At the front side of the each clamp 17, each wire rope 4 is installed by a wire rope protrusion installation means to protrude to the road direction side from the support 1.

In the wire rope protrusion installation means, at the front surface, a receiving groove 12 that receives the wire rope 4 is formed in a lengthwise direction of the wire rope 4, and at the rear side, a wire rope support 10 having a rear protrusion 11 inserted into a groove 19 is installed between a rear surface of the wire rope 4 and a front surface of the clamp 17, and at the outside in which the wire rope 4 is inserted into the receiving groove 12, in a state that encloses the wire rope support 10 including a front surface of the wire rope 4, at a front surface of the clamp 17, a wire rope holder 13 is installed by a bolt 8.

In FIG. 6, the wire rope support 10 is shown in a cube shape, but a front surface thereof is formed in a semicircular shape or a mountain shape, and in an intermediate portion thereof, a shape having the receiving groove 12 is formed in a lengthwise direction of the wire rope 4.

Figure 8:
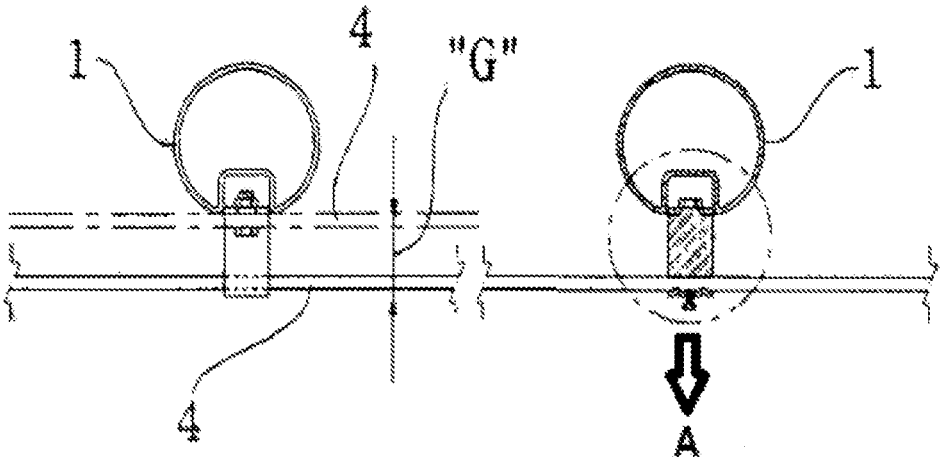
FIG. 8 is a top plan view of a guard cable for a road according to an exemplary embodiment of the present invention illustrating a state in which a wire rope is protruded by a predetermined width from a support to the roadside.
Figure 8A:
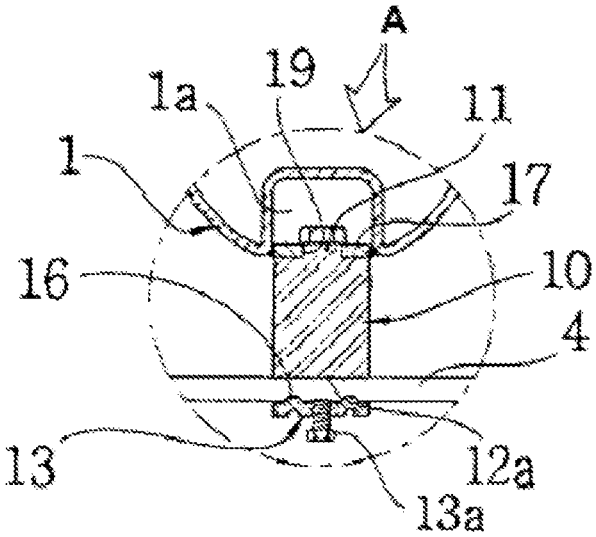
FIG. 8A is an enlarged view of area A of FIG. 8.

The bolt 8 penetrates a through-hole 15 of a blade portion 14 outwardly installed at the rear end of the wire rope holder 13 and the opening groove 18, and a nut 9 is fastened and coupled to a penetrated screw of the bolt 8, and as shown in FIG. 8A, at an inner surface of the wire rope holder 13 and the receiving groove 12 contacting with the wire rope 4, uneven portions 12*a* and 16 that prevent the wire rope 4 from sliding are each formed, and a fixing screw 13*a* that fixes the wire rope 4 by pressing is fastened to the wire rope holder 13.

Figure 4:
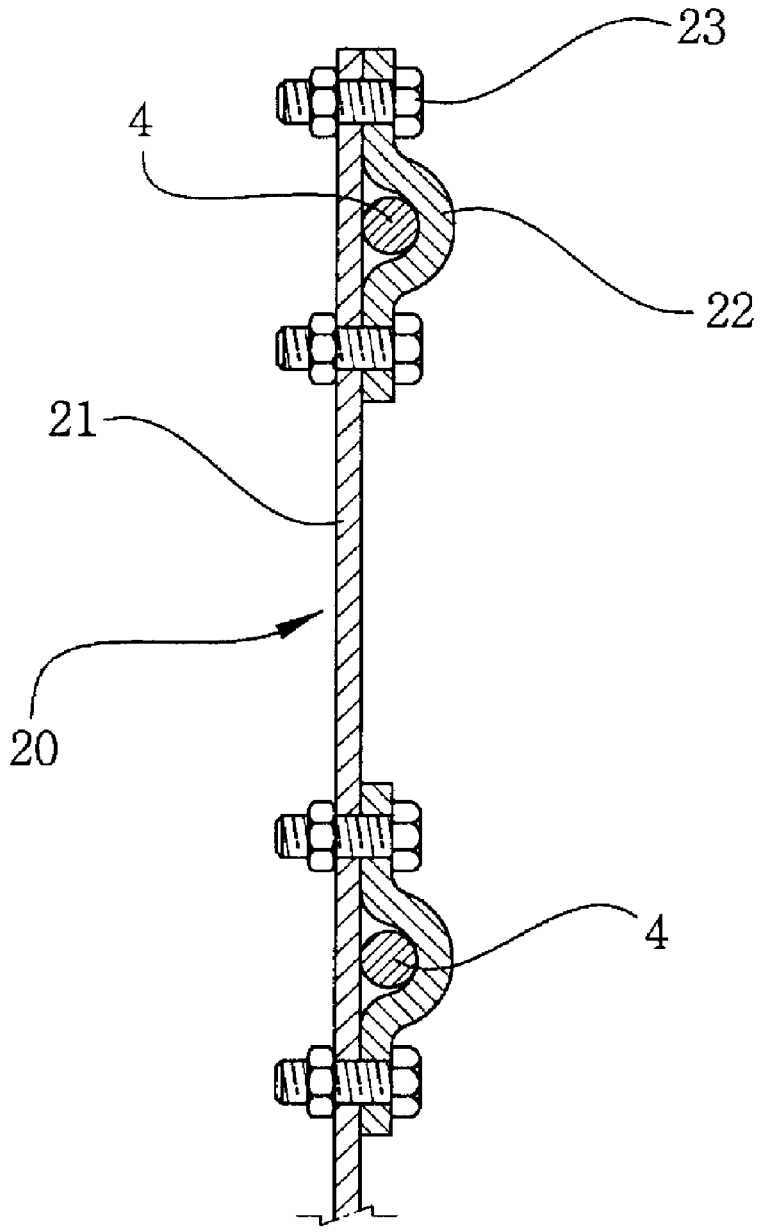
FIG. 4 is an enlarged side cross-sectional view of a portion "C" of FIG. 1.
Figure 5:
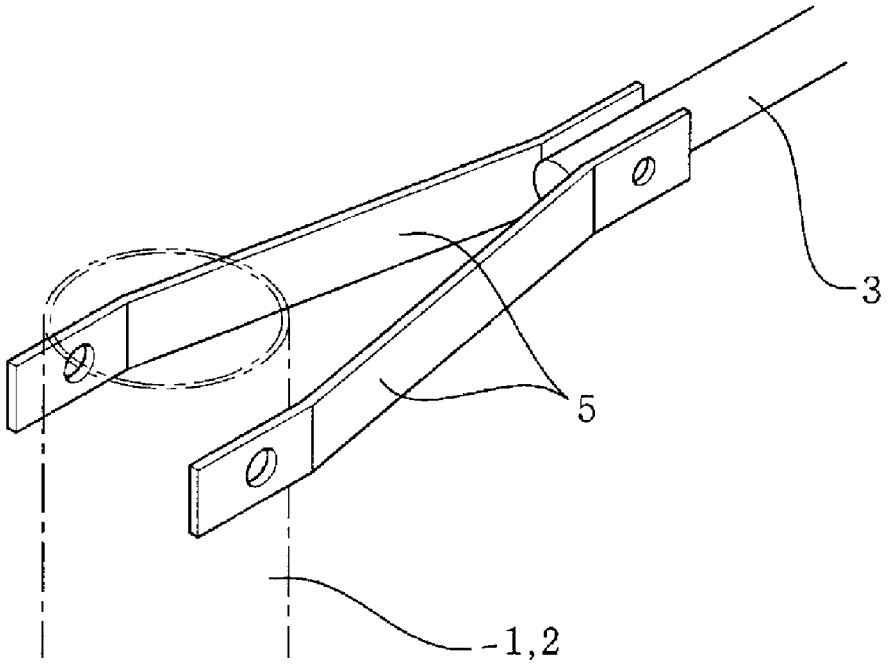
FIG. 5 is a perspective view of a connector shown in portions "A" and "B" of FIG. 1.

As shown in FIGS. 1 and 4, in the wire ropes 4 of several lines horizontally installed between the adjacent supports 1, a gap holder 20 that fixes the wire ropes 4 of several lines to maintain a constant gap is installed.

The gap holder 20 couples a clamp 22 that encloses each wire rope 4 as a fixing member 23 to a support 21 at the outside of the front side through which the each wire rope 4 passes in a state in which the support 21 supports a rear surface of the wire ropes 4 of several lines in a vertical direction, and at an installation position of the gap holder 20, the support 21 is installed at the front side of the wire rope 4, and the clamp 22 is installed at the rear side of the wire rope 4, and the fixing member 23 may be installed by a bolt, a net, and a rivet.

As shown in FIGS. 1 to 3 and FIG. 5, at the ground of the outside of the support 1 installed in both side end portions or one side end portion of the support 1, an auxiliary support 2 is installed at a gap from the support 1 of the end portion side in a height lower than the support 1 of the end portion side, and a pulling device 3 of a turnbuckle form is connected between an upper portion of the support 1 of the end portion side and an upper portion of the auxiliary support 2, and between both end portions of the pulling device 3 and the support 1 and the auxiliary support 2 corresponding to both end portions thereof, a connector 5 is connected by a fixing member 6.

Both end portions of the each wire rope 4 are coupled to an end portion of a splicer 7 that inwardly penetrates the support 1 installed in both end portions of the support 1, and the splicer 7 is disclosed in inventions of Korean Patent No. 10-1049437 (title: safety structure for road in which a pulling device is installed) applied before the present application and registered and therefore a detailed description of the splicer will be omitted.

Figure 9:
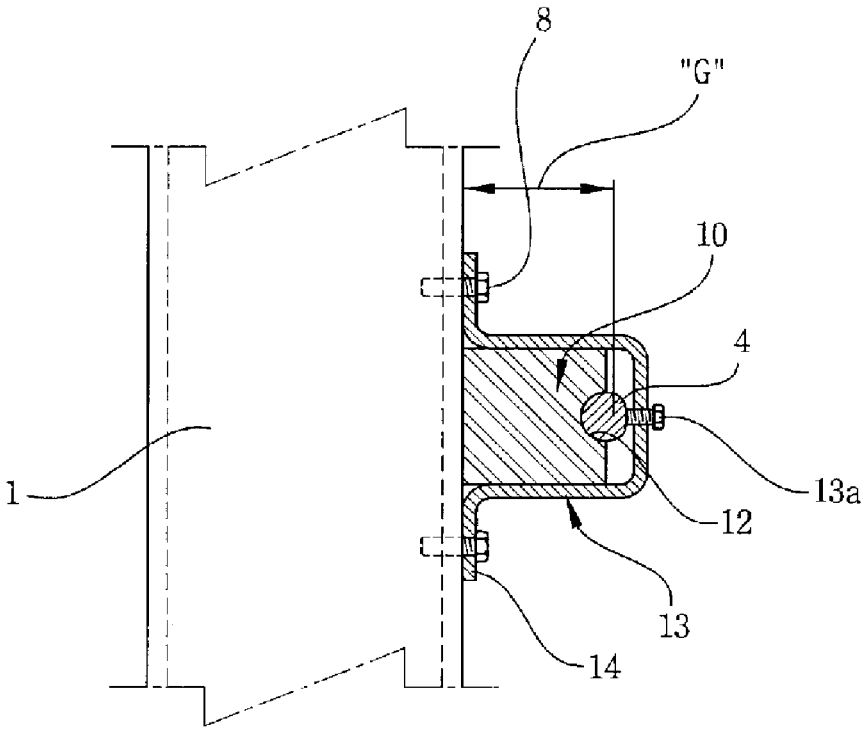
FIG. 9 is a side cross-sectional view illustrating another exemplary embodiment of an installation state of a wire rope, which is a main element of the present invention.

FIG. 9 is a side cross-sectional view illustrating another exemplary embodiment of an installation state of a wire rope, which is a main element of the present invention, and another exemplary embodiment of an installation state of the wire rope is entirely similar to an exemplary embodiment described with reference to FIGS. 6 and 7, but is partially different from the exemplary embodiment, and this will be described with reference to FIG. 9.

That is, in an exemplary embodiment of another installation state of the wire rope shown in FIG. 9, the each wire rope 4 is installed by a wire rope protrusion installation means to protrude to the road direction side from the support 1, and in the wire rope protrusion installation means, the receiving groove 12 in which the wire rope 4 is horizontally received at a front surface is formed in a horizontal direction, and the wire rope support 10 in which the receiving groove 12 is formed in a horizontal direction is interposed between a rear surface of the wire rope 4 and a front surface of the support 1.

Further, at the outside in which the wire rope 4 is inserted into the receiving groove 12, in a state that encloses the wire rope support 10 including a front surface of the wire rope 4, at a front surface of the support 1, the wire rope holder 13 is installed by the bolt 8, and the blade portion 14 in which the bolt 8 is penetrated is connected to a rear end portion of the wire rope holder 13 that faces a front surface of the support 1.

Operation of the present invention having the above-described configuration will be described with reference to FIGS. 1 to 9.

As shown in FIGS. 1 and 8, in a guard cable for a road according to an exemplary embodiment of the present invention, the auxiliary support 2 is installed in an end portion of a guard cable 100 installed at the roadside, and the pulling device 3 of a turnbuckle form is installed between the auxiliary support 2 and the support 1 of the end portion side and thus the support 1 of the both end portion side of the guard cable 100 is pulled toward the auxiliary support 2.

At the support 1 installed at both end portions, the splicer 7 is installed by pulling an end portion of the wire rope 4 with a screw method and thus the wire ropes 4 of several lines installed in the guard cable 100 may maintain a tight state instead of loosely drooping.

Further, in the wire rope 4 horizontally installed between the adjacent supports 1, the wire ropes 4 of several lines as the gap holder 20 maintain a constant gap, as shown in FIGS. 1 and 4.

In such a situation, when a vehicle collides with the wire rope 4 of the guard cable 100, while the vehicle collides with one or two wire ropes 4 of the wire ropes 4 of several lines, a load is transferred to a first contacting wire rope 4, but as described above, the wire ropes 4 of several lines are connected by the gap holder 20 and thus a load operating when the vehicle collides with the wire ropes 4 of several lines is distributed to the wire ropes 4 of several lines.

As a load operating when a vehicle collides distributes to several wire ropes 4 instead of concentrating to one or two wire ropes 4, a phenomenon that a vehicle in which the wire rope 4 collides falls to the outside of the road by overpassing the guard cable 100 and that a vehicle is caught between the wire ropes 4 does not occur.

As shown in FIGS. 6 to 9, wire ropes 4 of several lines are installed to protrude from the support 1 to the roadside by a width G of the wire rope support 10, and thus when a vehicle collides with the guard cable 100, the wire rope 4 may minimize the corresponding vehicle to fall to the outside of the road by a width protruded to the roadside.

The wire rope 4*a* shown by an imaginary line in FIG. 8 illustrates a position at which the wire rope 4*a* is adjacently installed to the support 1, in a conventional case having no wire rope support 10, which is a main portion of the present invention, and the present invention illustrates that the wire rope 4 is installed to protrude toward the roadside by a predetermined width G further than the conventional wire rope 4*a* by the wire rope support 10.

At the inside of the receiving groove 12 and the receiving groove 12 of the wire rope support 10 that holds the wire rope 4, when an impact is applied to the wire rope 4, uneven portions 12*a* and 16 that prevent the wire rope 4 positioned between the inside of the wire rope holder 13 and the receiving groove 12 from sliding are formed, and a fixing screw 13*a* that presses and fixes the wire rope 4 with a screw method is fastened to the wire rope holder 13.

Therefore, in normal times, the wire rope 4 horizontally installed between adjacent supports 1 may maintain a tight state instead of loosing, and when the vehicle collides with the wire rope 4, by preventing the wire rope 4 from being pulled to the side in which the vehicle collides, when the wire rope 4 collides with the vehicle, the wire rope 4 can rigidly support an impact load of the vehicle.

As shown in FIGS. 1, 2, 3, and 5, both end portions of the pulling device 3 and the support 1 and the auxiliary support 2 corresponding thereto are connected by the band type connector 5 and thus an installation and replacing work of the pulling device 3 can be simply performed and maintenance thereof can be conveniently performed.

Further, as shown in FIGS. 6 and 7, the rear protrusion 11 is formed at the rear side of the wire rope support 10, and in the clamp 17 corresponding thereto, a groove 19 that inserts the rear protrusion 11 of the rear side of the wire rope support 10 is formed, and when the wire rope support 10 is installed and when the rear protrusion 11 of the wire rope support 10 is inserted into the groove 19, the wire rope support 10 is not separated from the clamp 17 and thus an installation work of the wire rope support 10 can be conveniently performed.

The clamp 17 is fixed and coupled to an inlet of the inward groove 1*a* of the support 1, and in an upper portion and a lower portion of the clamp 17, the opening groove 18 in which an upper portion and a lower portion are opened is formed and thus while a head portion of the bolt 8 is inserted into the inward groove 1*a*, a screw portion of the bolt 8 is fastened to the nut 9 by penetrating the through-hole 15 of the wire rope holder 13 through the opening groove 18 and thus an installation work of a wire rope protrusion installation means can be simply performed.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

For example, in a shown exemplary embodiment, the wire rope holder 13 is fastened to the clamp 17 fixed to the inward groove 1*a* of the support 1, but it is not necessarily fastened thereto. For example, the wire rope holder 13 may be directly fastened to the support 1.

The invention claimed is:

1. A guard cable for a road in which a plurality of supports are installed at a gap at the roadside and in which wire ropes of several lines are parallelly extended in a lengthwise direction between each of the supports, wherein a receiving groove in which the wire rope is received at a front surface is located so that a wire rope support formed in a lengthwise direction of the wire rope protrudes from the support to the roadside and thus each wire rope is protruded from the support to the roadside, and in a state in which the wire rope is received at the receiving groove, a wire rope holder is installed in the support in a state that encloses the wire rope support comprising the wire rope, wherein a rear protrusion is formed at a rear side of the wire rope support, and in a clamp corresponding thereto, a groove that receives the rear protrusion of the rear side of the wire rope support is formed.

2. The guard cable of claim 1, wherein in each of the plurality of supports, an inward groove is formed in a vertical lengthwise direction, and in an inlet of the inward groove, the clamp that fastens the wire rope holder is installed, and at both ends of the clamp, an opening groove that receives a fastening device for fastening to the wire rope holder is formed.

3. The guard cable of claim 1, wherein at the inside of the wire rope holder and the receiving groove, uneven portions that prevent the wire rope from sliding are each formed.

4. The guard cable of claim 1, further comprising a fixing screw having the front end that close contacts with a wire rope received at the receiving groove by penetrating the wire rope holder.

5. The guard cable of claim 1, further comprising a gap holder that holds the parallelly extended wire ropes at a constant gap, wherein the gap holder couples the clamp formed to enclose each of wire ropes with the wire ropes interposed therebetween to a support with a fixing member in a state in which the support simultaneously supports the wire ropes.

6. The guard cable of claim 1, further comprising an auxiliary support installed at a predetermined gap from the plurality of support installed at both side end portions or one side end portion of the supports, wherein a pulling device of a turnbuckle form is connected between the support of the end portion side and the auxiliary support, and a connector is installed by a fixing member between both end portions of the pulling device and the support and the auxiliary support corresponding to the both end portions.

7. The guard cable of claim 1, wherein both end portions of each wire rope are coupled to an end portion of a splicer that penetrates a support of the end portion side of both sides.

* * * * *